United States Patent [19]

Larsson

[11] Patent Number: 4,777,868

[45] Date of Patent: Oct. 18, 1988

[54] FLEXIBLE ACTUATOR

[75] Inventor: Ove Larsson, Göthenburg, Sweden

[73] Assignee: Komatsu Ltd., Tokyo, Japan

[21] Appl. No.: 921,051

[22] PCT Filed: Dec. 17, 1985

[86] PCT No.: PCT/SE85/00528

§ 371 Date: Oct. 16, 1986

§ 102(e) Date: Oct. 16, 1986

[87] PCT Pub. No.: WO86/03816

PCT Pub. Date: Jul. 3, 1986

[30] Foreign Application Priority Data

Dec. 17, 1984 [SE] Sweden ..... 8406404

[51] Int. Cl.[4] ..... F01B 19/00

[52] U.S. Cl. ..... 92/42; 92/47

[58] Field of Search ..... 92/34, 35, 42, 47; 901/22

[56] References Cited

U.S. PATENT DOCUMENTS

| | | | |
|---|---|---|---|
| 1,054,197 | 2/1913 | Goydner etal. | 92/42 |
| 2,056,106 | 9/1936 | Kuhn | 92/42 |
| 2,365,063 | 12/1944 | Downey | 92/47 |
| 3,213,764 | 10/1965 | Nelson et al. | 92/47 |
| 3,401,607 | 9/1968 | Wordman | 92/42 |
| 3,584,093 | 6/1971 | Vernon | 92/42 |

FOREIGN PATENT DOCUMENTS

| | | | |
|---|---|---|---|
| 0918084 | 4/1982 | U.S.S.R. | 901/22 |

*Primary Examiner*—A. Michael Chambers

*Attorney, Agent, or Firm*—Cushman, Darby & Cushman

[57] ABSTRACT

A flexible actuator, comprising at least a pressure tube, which is axially extendable and/or contractable under influence of a pressure fluid. The object of the invention is to provide a flexible actuator, which can perform straight axial movements as well as curved movements in one or more planes and which can also operate at very high pressures. These objects have been achieved by the fact that the tube (12) with the exception of its end, connection or attachment parts (13) is corrugated and that at least the portions (10) of the corrugated tube, which are located between its outward projecting folds (9), are equipped with means (8) of a material which is unextensible as compared to the material of the tube, and arranged substantially to prevent a radial expansion and/or contraction of the tube in said portions (10).

7 Claims, 4 Drawing Sheets

FLEXIBLE ACTUATOR

The present invention refers to a flexible actuator, comprising at least one pressure tube, which is axially extendable and/or contractable by a pressure fluid.

BACKGROUND OF THE INVENTION

Flexible actuators, e.g. in the shape of bellows for performing straight axial movements are previously known. Bellows can only execute very limited movements and if the material of the bellows is rubber or the like it can only carry relatively low pressures.

In case larger axial movements are to be performed, for example one or several meters long, and under high pressure e.g. 200 bar or more, only piston-cylinders have up to now been used. If it however is also desired that the actuator should execute curved movements in one or several planes, piston-cylinders can not be used.

THE OBJECT AND MOST IMPORTANT FEATURES OF THE INVENTION

The object of the present invention is to provide a flexible actuator, which can not only perform straight axial displacement movements, but also curved movements and even work with very high pressures. These objects have been solved by the fact that the tube with the exception of its end-, connection- or attachment parts is corrugated and that att least the parts of the corrugated tube, which are located between its out-turned folds, are provided with a member made of a material which is not extensible relatively the material in the tube, and which members are arranged essentially to prevent a radial extension and/or contraction of the tube in said parts.

DESCRIPTION OF THE DRAWINGS

FIG. 3—of the tube is schematically illustrated,

DESCRIPTION OF THE EMBODIMENTS

Figure 1:
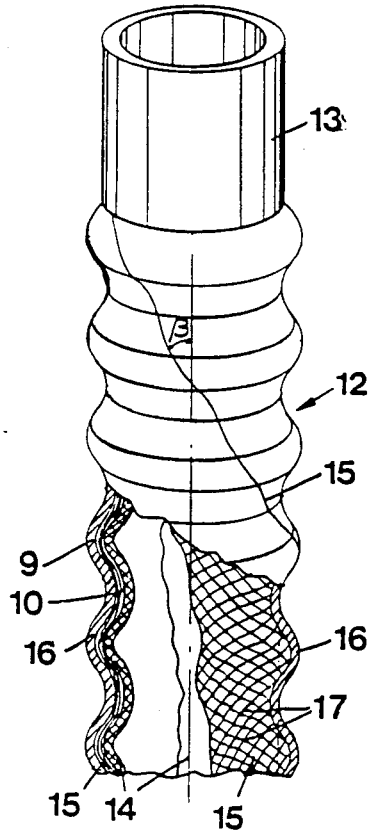
FIG. 1 shows a partly broken perspective view of an end portion of the tube according to the invention.

The actuator 11 according to the invention comprises at least one pressure tube 12 which with the exception of its end-, connection- or attachment portions 13 is corrugated. The pressure tube 12 consists of an inner tube 14 preferably made of a rubber material, which is provided with a member 8, which at least partially prevents the tube from radially extending and/or contraction. This inhibition, which is purposed to prevent the tube from being pressurized to baloon shape, can be achieved in different ways, and one possible way is a reinforcement 15 to arrange over the whole external envelope surface of the inner tube and a protective external tube 16, which for example could be rigidly shrinked on the reinforced inner tube. The reinforcement 15 is preferably made of fibres with very high tensile strength, for example aramid fibres steel or the like, which are helicaly wound around the tube, so that the wires of the reinforcement 15*a* follow the corrugated out-turned folds 9 as well as the parts 10 therebetween, which can be inwards-turned folds as well as cylindric portions. The helical reinforcement 15 is either directly wind on the inner tube 14 or is preferably manufactured in the form of a "sock" with reinforcement wires 17 arranged crosswise in right- and lefthand revolutions.

Figure 2:
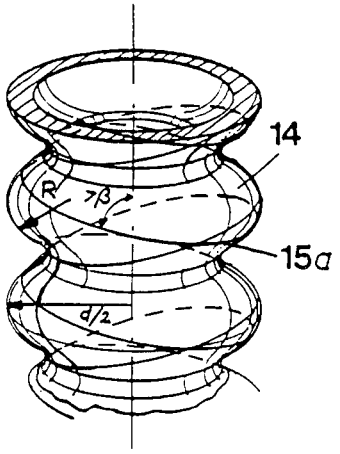
FIGS. 2 and 3 are also perspective views of portions of the tube according to the invention, where a reinforcement wire for providing an extension—FIG. 2—respective shortening—

If a tube 12 is to be made which under pressure should be extended the helix angle of the helical reinforcement to the longitudinal axle of the tube should be $>\beta-$FIG. 2—and if a shortening of the pressurized tube is desired the helical reinforcement 15 is designed with a helix angle which is $<\beta-$. In the parts of the tube in which neither an extension nor a shortening is desired the helix angle of the helical reinforcement is $\beta$. Practical tests have shown, that during certain assumptions a helix angle $\beta$ of about 54 degrees is appropriate. The helix angle $\beta$ should all the time be adapted to the varying circumference of the corrugated tube during the winding.

The portions 13 of the tube 12, which are not directly exposed to the effect of the pressure fluid, e.g. the end portion of the tube or a part of the tube which is connected or attached to any inlet peice in the flexible actuator, is designed without any corrugations and preferrably cylindric. The reinforcement 15 in these parts 13 are mechanically fixed, for example by means of a rigidly pressed casing 24 on the tube, so that it in these parts can not perform any movements.

It is further of a certain importance that the folds of the tube are curved in a certain way and in tubes which are intended to be extended under pressure, i.e. where the helix angle of the helical reinforcement is $>\beta-$, the curvature resp. the radius of the fold should be $<\alpha$, while for tubes which are shortened under pressure, i.e. where the helix angle of the helical reinforcement is $<\beta-$, the curvature resp. the radius of the fold should be $>\alpha$, at which $\alpha$ corresponds to the curving resp. the radius at which the corrugated tube is in neutral position, i.e. neither is extended nor pressed together. A normal value for $\alpha$ can for example be d/2, where "d" is the outside diameter of the inner tube.

Figure 3:
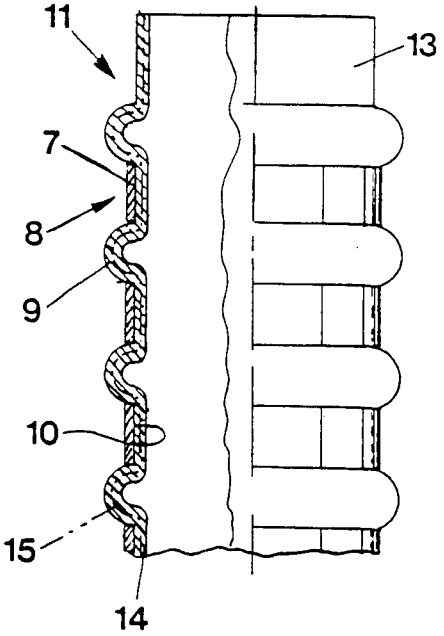

In FIG. 3 a slightly modified performance of the corrugated tube 11 is illustrated, where the inhibit member 8 are collars 7 placed around the parts 10, which are located between out-turned folds 9. The collars can be loosely located or fixed, i.e. grouted collars of steel or other material with high resistance. In order that the corrugated tube should resist very high pressure, it is appropriate to reinforce the tube 12 with the above mentioned helical reinforcement 15 as well as with the circumferential collars 7 in the parts 10. The reinforcement does not need to be spirally wound if circumferential wires 7 are used as inhiber member 8, and in this case if it is spirally wound it can also have a neutral helix angle $\beta$.

Figure 4:
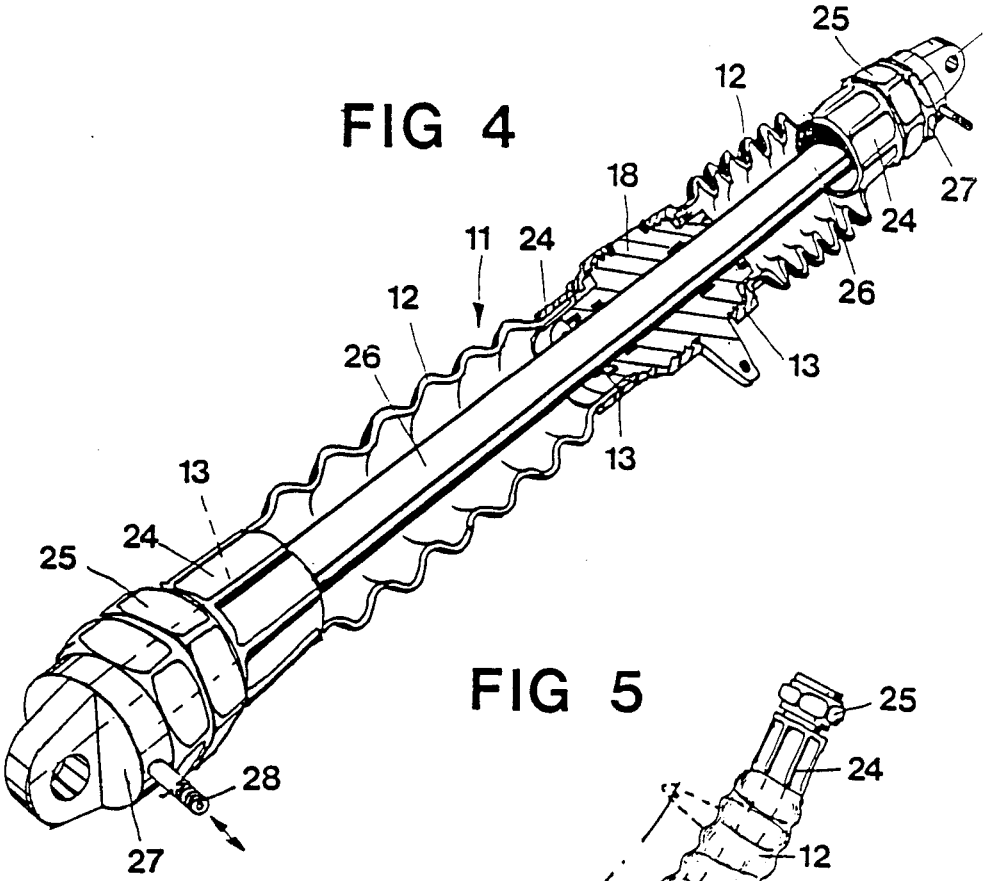
FIG. 4 is a perspective view and partly in section of a straight actuator according the invention, FIG. 5 a side view of a modified actuator which can make curved movements.

In FIG. 4 an embodiment is illustrated showing how two pressure tubes 12 according to the invention can be utilized in an actuator 11 for providing a reciprocating linear movement. Both end portions 13 of the corrugated pressure tubes 12, as their reinforcment 15 are by means of locking members 24 in the form of pressure casings firmly fixed at one end to a piston 18 and at the other end to a connection member 25. The connection members are connected to an attachment 27 each, which together support a through rod 26. The attachment 27 is provided with an inlet plug 28 for the connection of the actuator to a pressure source. The piston 18 is axially displaceable along the rod 26. Both tubes 12 are helically reinforced with a helix angle to the longitudinal axle of the tube which is $>\beta$, i.e. larger than 54°, for example 59°, so that when one of them is pressurized an extension is obtained, while the pressure fluid of the other tube is evacuated, through which the piston 18 can be brought to perform a linear movement in a desired direction.

Figure 5:
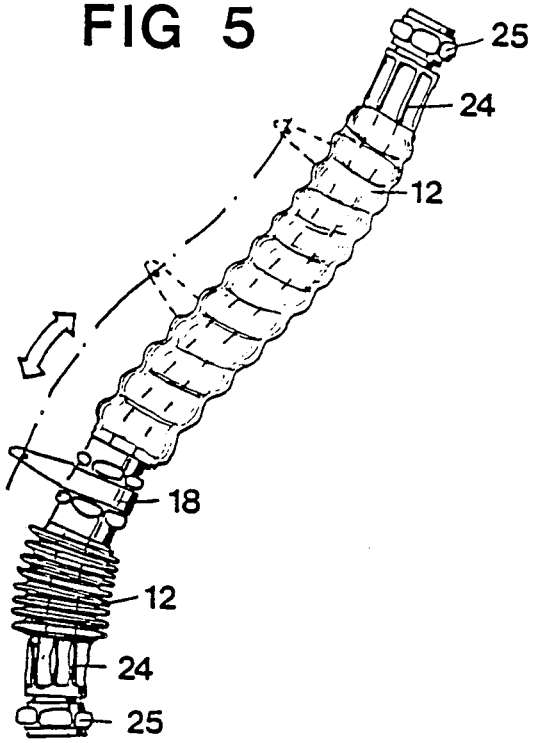

In case a curve line-guided actuator is desired the rod 26 could be given the desired curvature, as is shown in FIG. 5. Such curve line-guided actuators could be used for example for guiding of automatons for spraying car bodies, at which the rod 26 can be given the same curvature as the outer contour of the car body which is to be sprayed. It is also possible to curve the rod in a circle shape or in form of one or several helical windings so that also composited circular movements could be performed.

Figure 6:
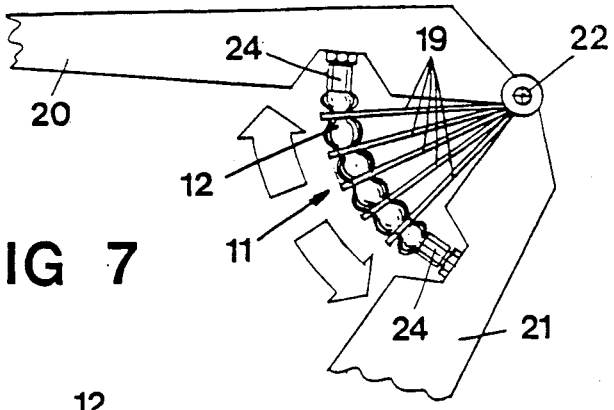
FIG. 6 is a side view of another application of the actuator provided with collapse-preventing stays.

If the actuator according the invention is utilized e.g. as a hydraulic adjusting means between two moveable arms according to FIG. 6, it could be necessary to arrange stays 19, which prevent uncontrolled collapsing of the tube. Such stays 19 are provided with ring shaped attachments which are placed round the inwardly or outwardly turned folds 9 or 10 of the corrugated tube. The stays 19 are connected to a holder-on, which in the shown embodiment consists of the joint part 22 of the two-armed construction 20, 21.

Figure 7:
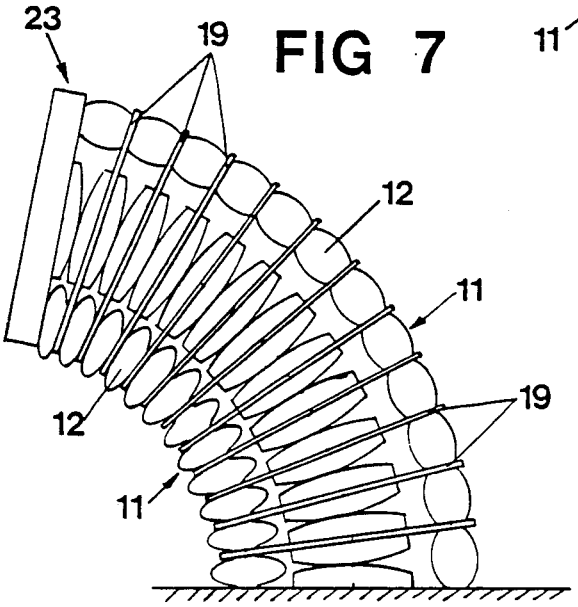
FIG. 7 is a side view of a flexible robot arm provided with several actutors according to the invention.

The actuator according the invention can with advantage be used in such robot arms, which are flexible along their whole length freedom and where the actuator means, which previously have consisted of a number of wires with respect to the power-generating means, have been replaced by a corresponding number of actuators, i.e. four tubes, according the invention, as shown in FIG. 7. In this embodiment the stays 19 are designed as connection stays, which connect all actuators of the flexible robot arm with each other. The connection stays 19, which surround some or all inwardly turned folds of each individual pressure tube can make a part of the torsional members which are included in the flexible arm in order to increase the stiffness thereof perpendicular to the rolling-off direction.

Figure 8:
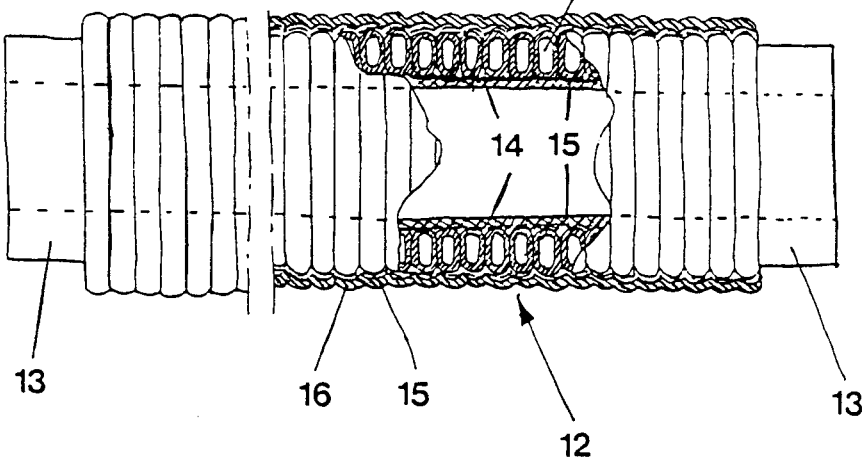
FIG. 8 shows a further variant of a pressure tube which is a part of the actuator.

The pressure tube 12 of the actuator 11 can also be made double-walled and such an example is shown in FIG. 8. The pressure tube consists of a spirally wound thinner tube 24, which in decompressed condition is vulcanized to a cylindric unit. Outside and inside the tube manufactured in this way helical reinforcements 15, which are protected by a external and internal tube resp. 16 resp. 14, are arranged.

Figure 9:
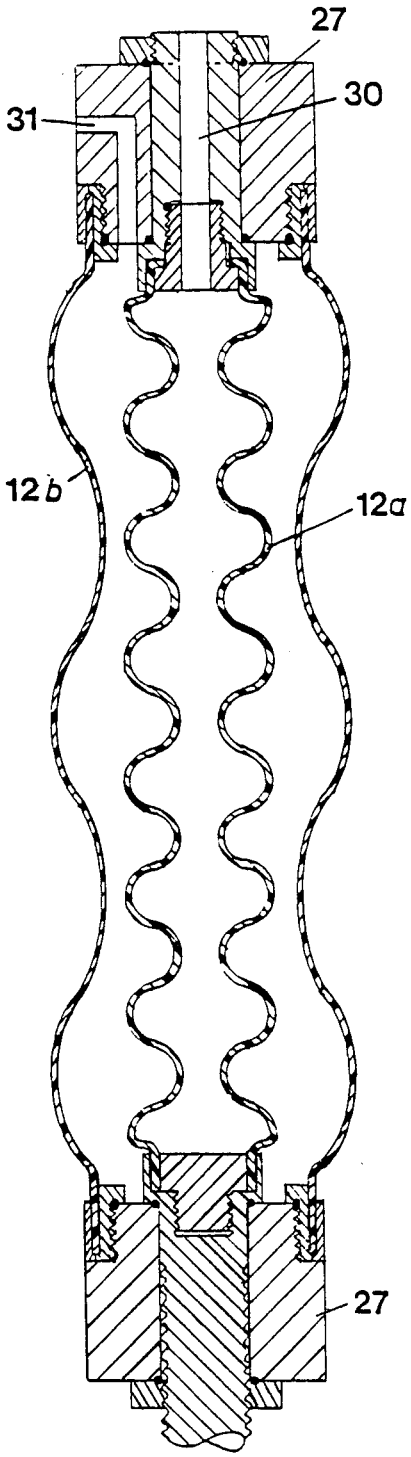
FIG. 9 shows a section through an actuator designed as a double-acting cylinder.

The embodiment shown in FIG. 9 relates to a actuator with double acting function. In this embodiment two tubes are provided, one inside the other, both of them are connected to a joint socket 27. At least in one socket 27 double feed channels 30, 31 are arranged, one of which 30 communicates with the inside of the inner tube 12*a*, while the other feed channel 31 communicates with the space which is enclosed by the outer tube 12*b* and the outside of the inner tube 12*a*. In order to provide the double acting function one of the tubes is provided with such a helical reinforcement 15 that an extension of the tube is obtained while the reinforcement 15 of the other tube provides a shortening of the tube.

Figure 10:
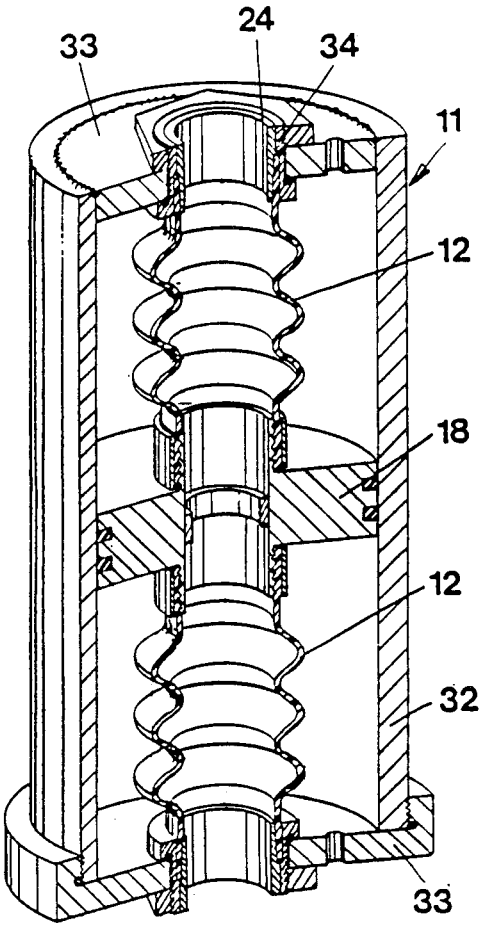
FIG. 10 shows in perspective and in section an actuator according to the invention with a hollow cylinder-piston.

A further embodiment is shown in FIG. 10, which relates to an adjusting means with a hollow cylinder 32 and a hollow piston 18 displaceable therein. The hollow cylinder is at both ends "sealed" by means of ring shaped gables 33 provided with a connecting piece 34 for firmly fixing the end portions 13 to a tube 12 each, while the opposite end portions are liquid tight connected to he connection means of the hollow piston 18. The tubes 12 are in the same way as in the embodiment according to FIG. 4 helically reinforced for extension of the tube.

What is claimed is:

1. A flexible actuator, comprising:

at least one pressure tube having a corrugated part which is axially extendable or contractable and attachment parts formed at an end portions of the corrugated part; and at least one helical reinforcement mechanically fixed to the attachment parts and helically surrounding said pressure tube such that, in a passive position of the tube, the reinforcement is arranged to have a helix angle with respect to a longitudinal axis of the tube, said reinforcement causing said corrugated part neither to extend nor to contract when said helix angle has a value of $\beta$ even when said tube is pressurized by a pressure fluid, said helix angle being determined to have a value larger than $\beta$ for the corrugated part to be extended when the tube is pressurized by a pressure fluid, and to have a value smaller than $\beta$ for the corrugated part to be contracted when the tube is pressurized.

2. A flexible actuator according to claim 1 helical reinforcement consists of reinforcement wires arranged crosswise in right- and lefthand revolutions, which preferably are surrounded by a protective covering.

3. A flexible actuator according to claim 1 wherein, at least the out-turned folds of the tube are curved along a radius which—for tubes with a helix angle $<\beta$ of the helical reinforcement—is $<\alpha$, while the radius—for tubes with a helix angle $>\beta$ of the helical reinforcement—is $>\alpha$, at which $\alpha$ corresponds to the curve of the radius at which the corrugated tube is in neutral position, i.e. neither is extended nor pressed together.

4. A flexible actuator according to claim 1 and of the kind which is a part of power-generating actuating members in hydraulic adjusting means, wherein at least some of the inwards or outwards turned folds of the corrugated tube are provided surrounding guides (19) connected to the adjusting means and intended to prevent uncontrolled collapse of the tube.

5. A flexible actuator according to claim 1 wherein, one end of the tube is firmly fixed to a socket (27) for a rod (26), along which a piston is axially displaceable, and that the opposite end of the tube is connected to said piston.

6. A flexible actuator according to claim 1 wherein, the tube is double-walled, preferably manufactured of a helically wound thinner tube, which is vulcanized together with the inner tube and provided with helical reinforcement on the outside of the tube as well as on the inside of the tube.

7. A flexible actuator according to claim 1 wherein, two tubes are provided one inside the other and at the ends are connected to joint sockets, wherein the helical reinforcement of one of the tubes has a helix angle with respect to the longitudinal axis of the tube which is $<\beta°$ and wherein at least in one socket are arranged channels for pressure liquid to the inner space of the inner tube and the space between the tubes.

* * * * *